US006553622B2

(12) United States Patent
Maruyama et al.

(10) Patent No.: US 6,553,622 B2
(45) Date of Patent: Apr. 29, 2003

(54) CONNECTING FASTENER

(75) Inventors: Toshio Maruyama, Toyohashi (JP); Ken Kataoka, Tokyo (JP); Masasi Nanba, Okayama (JP); Ryukei Shimizu, Okayama (JP)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 09/934,889

(22) Filed: Aug. 22, 2001

(65) Prior Publication Data

US 2002/0046443 A1 Apr. 25, 2002

(30) Foreign Application Priority Data

Sep. 5, 2000 (JP) ..... 2000-268107

(51) Int. Cl.[7] ..... E05F 1/08
(52) U.S. Cl. ..... 16/277; 16/286
(58) Field of Search ..... 16/277, 281, 280, 16/286; 296/76

(56) References Cited

U.S. PATENT DOCUMENTS 2,235,984 A * 3/1941 Devereaux ..... 16/295
2,975,491 A * 3/1961 Paul et al. ..... 16/267
2,976,766 A * 3/1961 Bianchi ..... 16/228
3,092,870 A * 6/1963 Baer ..... 16/277
3,195,172 A * 7/1965 Gionet ..... 16/289
3,477,091 A * 11/1969 Gordon ..... 16/227
3,713,578 A * 1/1973 Johnson ..... 16/225
4,363,191 A * 12/1982 Morgan ..... 16/225
5,124,715 A * 6/1992 Homer ..... 16/286
6,135,530 A * 10/2000 Blaszczak et al. ..... 16/286
6,428,176 B1 * 8/2002 Nelson ..... 362/31

* cited by examiner

*Primary Examiner*—Robert E. Pezzuto
*Assistant Examiner*—Tara L. Mayo
(74) *Attorney, Agent, or Firm*—Edward D. Murphy

(57) ABSTRACT

A connecting fastener 1 in which a first member 2 and a second member 3 are linked so that they can turn relative to one another is provided with (1) a first plate part 5 which is fixed to a fixed member 2; (2) a second plate part 6 which is fixed to a second member 3; and (3) a hinge 7 set in place between the first plate part and the second plate part and supporting both plate parts so that they can turn relative to one another; the first plate part, second plate part and hinge part forming an integral piece as they are made of a synthetic resin. Then, a spring 9 is set in place on the first plate part 5 and the second plate part 6, the spring 9 energizing so that both plate parts are in a non-turning state on either side of the hinge 7.

3 Claims, 5 Drawing Sheets

CONNECTING FASTENER

BACKGROUND OF THE INVENTION

The present invention relates to a connecting fastener which links two members so that they can turn mutually and so that the two members can turn relative to one another.

Connecting fastener that can turn should be placed on the bent part of a part required so that two members can turn relative to one another such as an automobile trunk board which can be bent. However, setting in place a metal hinge on the turning part of an automobile trunk board runs contrary to the concept of making the automobile lighter. In addition, the many bolts and other tools used for attachment as well as the many steps required therefor make these connecting fasteners undesirable.

The prior art discloses a turning connecting fastener which is made of synthetic resin so that it forms an integral piece and is used to link a small box which can turn around a larger box and which links a printed circuit substrate so that it can turn. These turning connecting fasteners which are made of synthetic resin are ideal in that they are lightweight. However, these connecting fasteners are not strong enough to link two members and other types of automobile trunk boards and do not have the restitutive force required to automatically return automobile trunk boards and the like to their original state (non-turning state).

SUMMARY OF THE PRESENT INVENTION

As a result, an object of the present invention is to provide a hinge-type connecting fastener which can be rendered lighter, which can return [the members] to the original [non-turning] state, which has fewer parts and fewer steps required for attachment.

In order to attain these objectives, the present invention provides a connecting fastener which links two members so that one member can turn relative to the other member and which is provided with (1) a first plate part which is fixed to one of the aforementioned members; (2) a second plate part which is fixed to the other member; and (3) a hinge part which is set in place between the aforementioned first and second plate parts and which supports both plate parts so that they can turn relative to one another. The first plate part, the second plate part and the hinge part are made of a synthetic resin so that they form an integral part and a spring is set in place so that both plate parts are energized in a non-turning state on either side of the hinge part. A synthetic resin is used to make the piece more lightweight, and the two members can be linked so that they turn merely by fixing the first plate part to one member and by fixing the second plate part to the other member so that it can be returned automatically to a non-turning state even if it is turned.

A spring coil is used for the spring in the aforementioned connecting fastener. One end of the coil spring is latched onto a first hooking part which is set in place on the first plate part and the other end of the coil spring is latched onto a second hooking part which extends from the second plate part to the first plate part while going past the hinge part. The aforementioned coil spring is maintained so that it is virtually parallel along the surface of the first plate part even when the second plate part turns relative to the first plate part. The second plate part should always be energized relative to the first plate part in a direction such that it does not turn.

The hinge part is also made up of (1) a first base which protrudes from the end part of the first plate part to the side of one member mentioned previously; (2) a second base which protrudes from the end part of the second plate part to the side of the other members; and (3) a light case between the first base and the second base; said hinge part should protrude from both plate parts to the side of the aforementioned member when the first plate part and the second plate part are in a non-turning state. In this case, a recessed part which accommodates the aforementioned protruding hinge part should be formed on the two members on the respective boundary parts of both members on which the hinge part is disposed.

The first plate part and the second plate part should be fixed respectively on one of the aforementioned members and on the other member using a rivet, bolt or other fixing means. Separate from these, a fixing part which is made up of (a) a shaft part which protrudes to the side of the first member and the second member and (b) a flange on the end of said shaft part is formed respectively on both the first and second plate parts. An attachment hole that is made up of (1) a large hole which can accommodate the aforementioned flange and (2) an adjoining small hole which can accommodate the aforementioned shaft part but which is too small for the flange to pass by is formed respectively on both members. The respective fixing part and shaft part are disposed in a small hole which accommodates the aforementioned attachment hole of the corresponding member and should be fixed on the member to which both plate parts respectively correspond.

BRIEF DESCRIPTION OF THE ACCOMPANYING DRAWINGS

DETAILED DESCRIPTION OF THE INVENTION

With reference to the drawings, FIG. 1 through FIG. 5 indicate the configuration of a connecting fastener 1 embodying the present invention. Connecting fastener 1, for example, may be used to link the two members so that one of the members turns in relation to the other member. In the practical embodiment, connecting fastener 1 links the two members, that is, the first member 2 (one member) and the second member 3 (the other member) such as a bendable trunk board and the like can turn as indicated in FIG. 7. In the practical embodiment, the second member 3 turns relative to the first member 2; however, this is just an example, and either member could turn relative to the other member. The first member 2 may turn relative to the second member 3 and any turning state is possible as long as both members can turn relative to one another. Next, we shall describe connecting fastener 1 in greater detail by referring to FIGS. 1 through 7.

Figure 1:
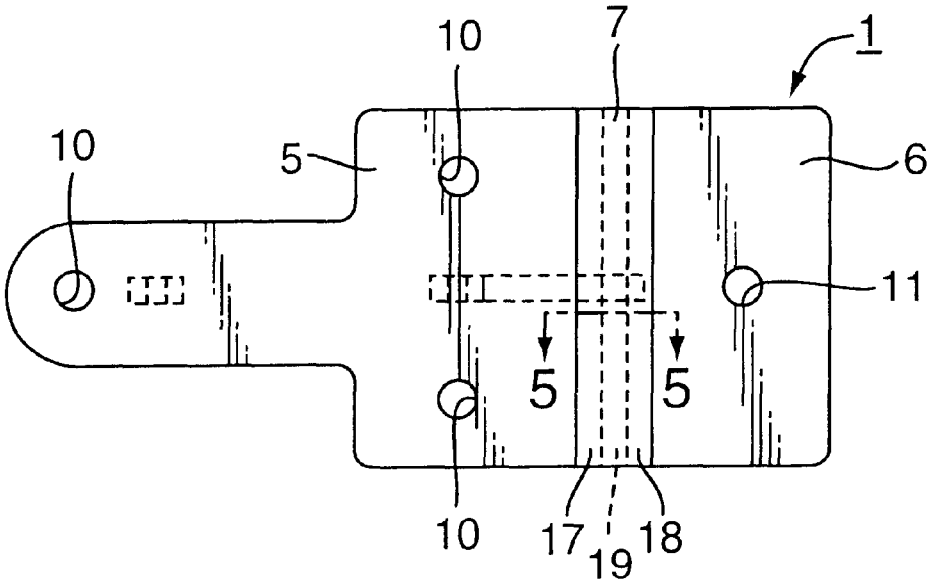
FIG. 1 is a plane view of the connecting fastener in the first practical embodiment of the present invention.
Figure 2:
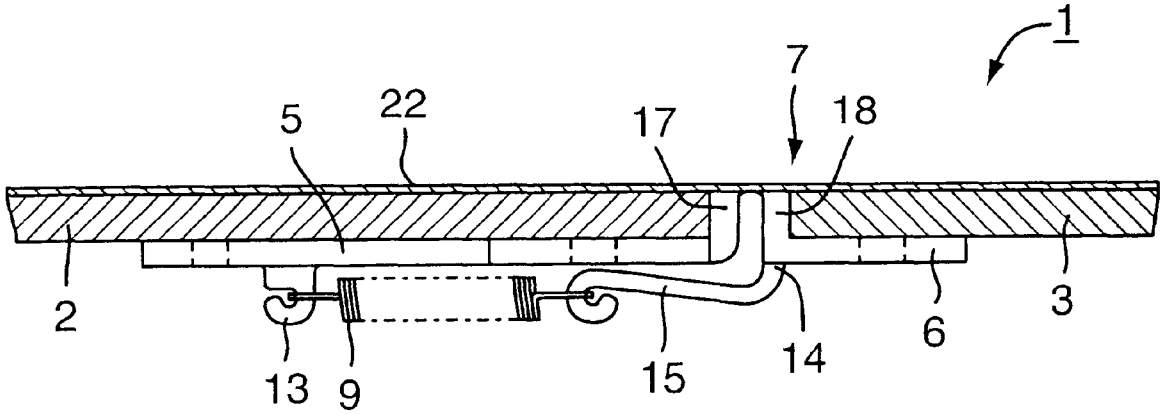
FIG. 2 is a frontal view of the connecting fastener indicated in FIG. 1 with virtual connecting member indicated.
Figure 3:
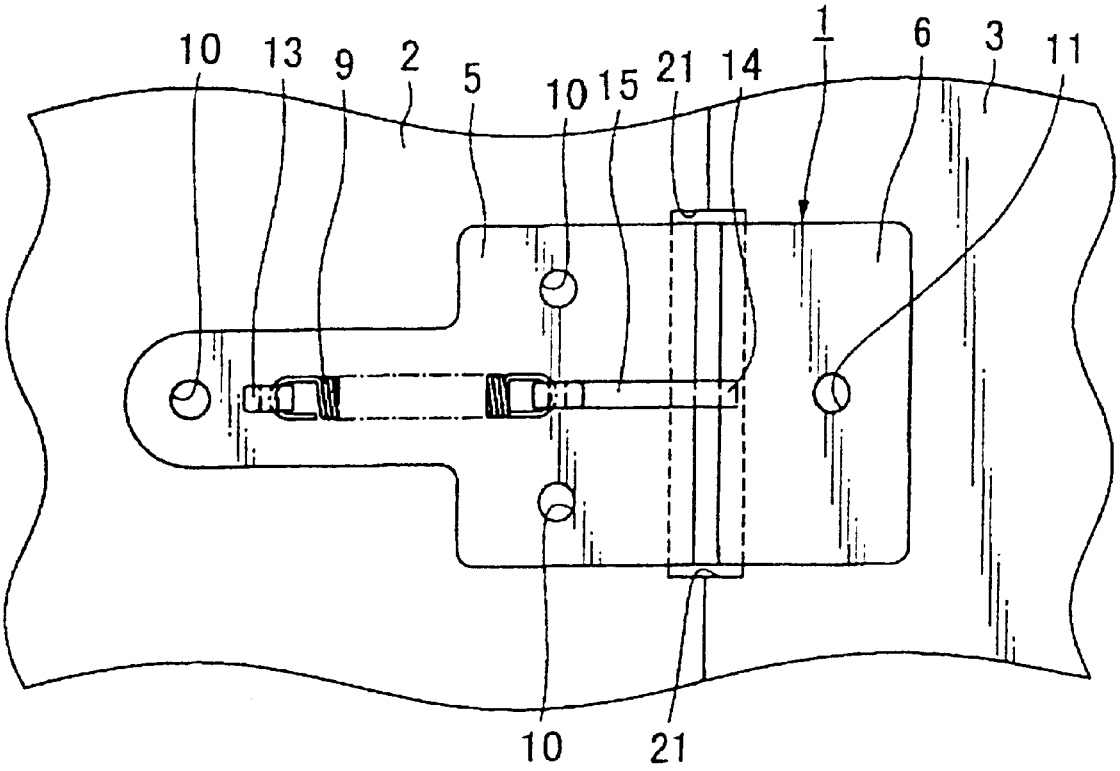
FIG. 3 is a bottom view of the connecting fastener indicated in FIG. 1 with virtual connecting member indicated.
Figure 4:
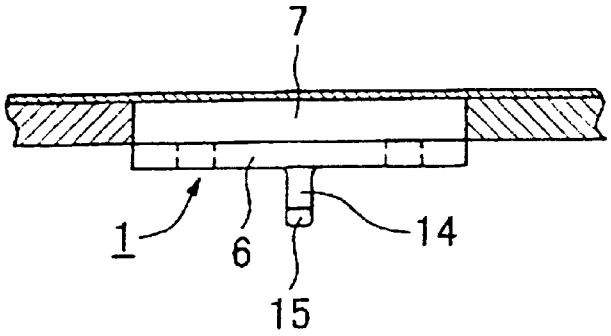
FIG. 4 is a right-hand lateral view of the connecting fastener indicated in FIG. 1 with virtual connecting member indicated.

Connecting fastener 1 is provided with (1) a first plate part 5 which is fixed to the first member 2; (2) a second plate part 6 which is fixed to the second member 3; and (3) a hinge part 7 which is set in place between the first plate part 5 and the second plate part 6 and supports both plate parts so that they can turn relative to one another. This first plate part 5, second plate part 6 and hinge part 7 are made of a synthetic resin and form an integral piece. Thus, since the integral piece can be made lightweight and the piece can be mass produced, it is inexpensive to manufacture. A spring 9 is also set in place on the first plate part 5 and the second plate part 6 so that both plate parts 5 and 6 are energized in a non-turning state on either side of hinge 7 (in other words, the first plate part 5 and the second plate part 6 are at a position which is on the same [horizontal] surface as indicated in FIG. 2). Therefore, as long as the first plate part 5 is fixed to the first member 2 and the second plate part 6 is fixed to the second member 3, the two members 2 and 3 can be linked so that they can turn using hinge part 7 and the two members 2 and 3 can be returned automatically to a non-turning state using spring 9 even if the two members are turned relative to one another.

The first plate part 5 is formed so that it is a slightly elongated overall so that spring 9 can be disposed on it. Holes 10 are formed at multiple locations and a rivet, bolt or other fixing means used for attaching to the first member 2 can pass through this. The second plate part 6 is formed so that it is slightly shorter than the first plate part 5, and has a hole 11 therein. A rivet, bolt or other fixing means is passed through hole 11 on the second plate part 6 for attaching it to the second member 3.

In the practical embodiment of the present invention, spring 9 is configured of a coil spring. As indicated in FIG. 2, the coil spring 9 is maintained at a position which is substantially parallel along the surface of the first plate part 5. Therefore, a first spring hooking part 13 which latches onto one end of the coil spring is formed on the first plate part 5 on a part which corresponds to a T-shaped foot. The other end of the coil spring 9 is attached to the second plate part 6. In the practical embodiment of the present invention, the other end of the coil spring 9 has a spring hooking part 15 which is formed on the second plate part 6 which is used to maintain the coil spring 9 at a position which is parallel to the surface of the first plate part 5. The coil spring 9 is latched onto the second spring hooking part 15 which is formed as a long narrow arm which extends from the second plate part 6, passes by the hinge part 7 and extends up as far as the intermediate position of the first plate part 5. Further, the shape of the first spring hooking part 13 and the shape of the part which latches onto the spring on the second spring hooking part 15 are not restricted to the hook shape indicated in the drawings but may be any other suitable shape, such as ring-shaped. Thus, the coil spring 9 is maintained at a position which is parallel to the surface of the first plate part 5 so that the spring is always energized for the second plate part 6 in a direction such that it is in a non-turning state relative to the first plate part 5 even if the second plate part 6 is turned relative to the first plate part 5. An automatic return to the non-turning state can be obtained reliably even if the two members are turned relative to one another. Further, the second spring hooking part 15 is formed as an elastic arm so that the tensile force is parallel to the first plate part 5. It is also curved so that it does not interfere with the hinge part 7 when the second plate part 6 is turned.

Figure 5:
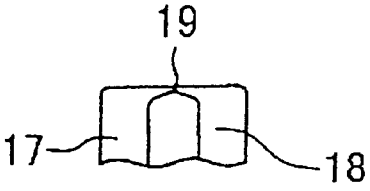
FIG. 5 is an enlarged view taken along line 5—5 of FIG. 1.

The hinge 7 is a part used as the tool which links the first plate part 5 and the second plate part 6 so that they can turn and has a long narrow band shape which intersects both of the plate parts. This hinge 7 is made up of (1) a first base 17 which protrudes from the end part on the side of the hinge in the first plate part 5 to the side of the first member 2; (2) a second base 18 which protrudes from the end part of the side of the hinge of the second plate part 6; and (3) a long narrow light case part 19 which is located between the first base 17 and the second base 18 to interconnect them in hinge fashion. FIG. 5 shows the hinge connection of the first base 17, the second base 18 and the light case part 19 enlarged. First base 17 and second base 18 protrude so that the hinge 7 protrudes from both plate parts as far as the height of the first base 17 and second base 18 on the side of the first member 2 and the second member 3 when the first plate part 5 and the second plate part 6 are at a non-turning position (that is, in the position indicated in FIG. 2). This protrusion height should be equal to the thickness of the first member 2 and the second member 3. A recessed part 21 (see FIG. 3) which accommodates the hinge 7 is formed on both side parts on the boundary of both members at the position where the hinge 7 is disposed on the first plate part 2 and the second plate part 3 to receive the protruding hinge 7. The connecting fastener 1 is positioned appropriately on the first member 2 and the second member 3 using this recessed part 21 merely by pushing the hinge 7 into the recessed part so that the connecting fastener 1 can be easily positioned on the first and second members. The recessed part 21 should have a depth that is at least as high as the hinge 7 and may be made to penetrate the top side as indicated in FIG. 2.

By making the protruding height of the hinge 7 the same as the thickness of both members, the light case part 19 is positioned at the same height as the surface of both members and is advantageous in that wrinkles do not appear when the second member 3 is turned.

Figure 6:
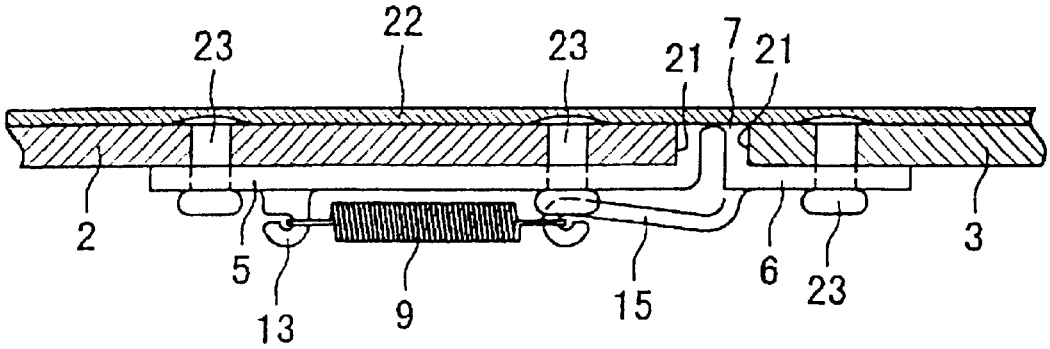
FIG. 6 is a frontal view of the connecting fastener in FIG. 1 when attached to a member.
Figure 7:
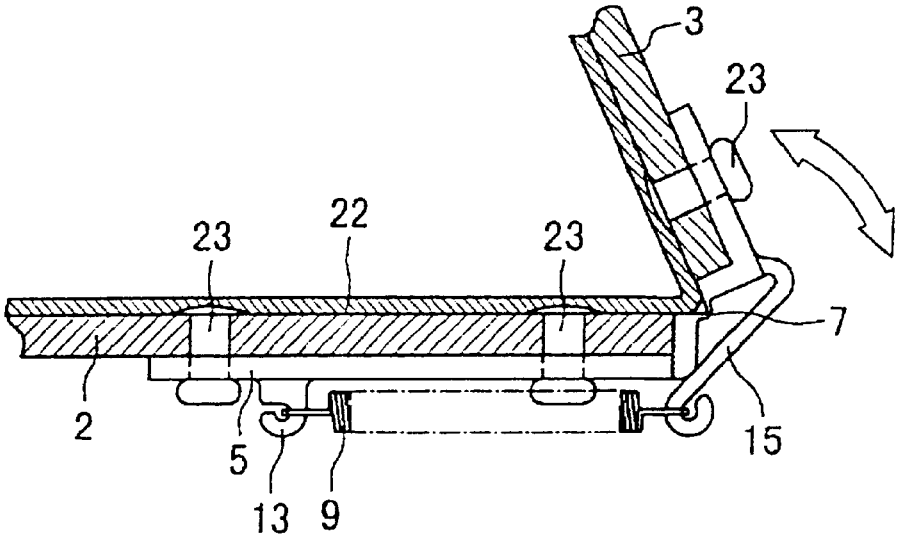
FIG. 7 is a frontal view of the connecting fastener in FIG. 1 when attached to a member and the second member is turned.
Figure 8:
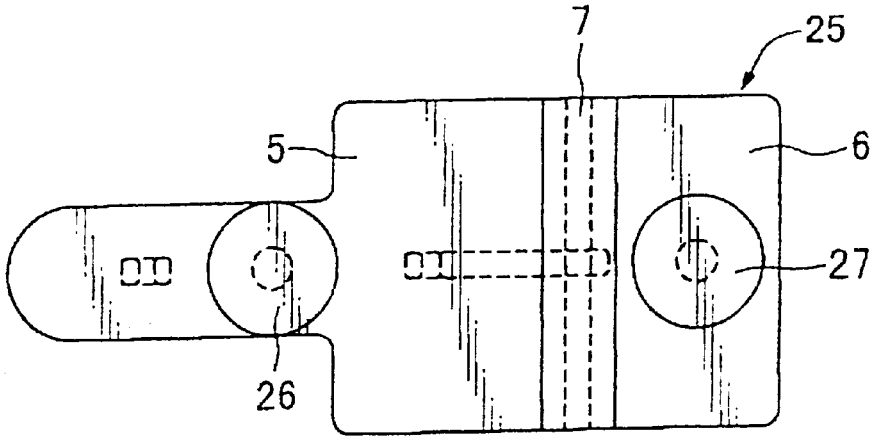
FIG. 8 is a plane view of the connecting fastener in the second practical embodiment of the present invention.
Figure 9:
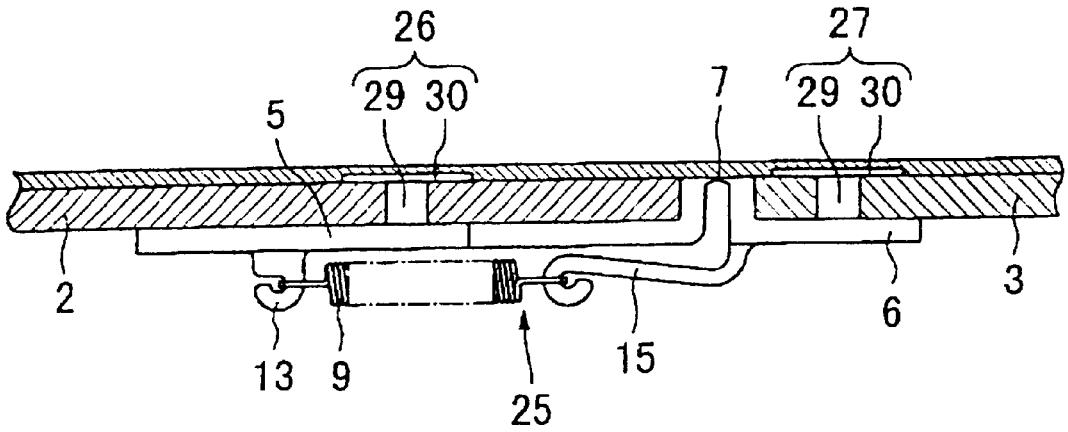
FIG. 9 is a frontal view of the connecting fastener in FIG. 8 with a virtual connecting member indicated.

FIG. 6 indicates the first member 2 and the second member 3 when they are linked so that they can turn using the connecting fastener 1 in the first practical embodiment of the present invention. In FIG. 6, the protruding hinge 7 is first inserted into the recessed part 21 which is formed on the boundary parts of the first member 2 and the second member 3 and positioned there. By positioning in this way, the hole in the first member 2 and the hole 10 in the first plate part 5 coincide, and the hole in the second member 3 and the hole 11 in the second plate part 6 coincide. Next, rivet 23 (to include a blind rivet and the like) or other fixing means is inserted in these holes; the first plate part 5 is fixed in the first member by joining with the fixing means and the second plate part 6 is fixed to the second member 3. After these are fixed, a skin-like covering material is mounted thereon; the outside appearance is adjusted to look suitable and the first member and the second member are protected thereby.

FIG. 7 shows the second member 3 that is linked to the first member 2 by the link 1 and turns relative to the first member 2 with the hinge 7 as the center. Even after turning has taken place, the coil spring 9 is maintained at a position parallel along the surface of the first plate part 5 so that the second plate part 6 is always energized by the spring in a direction which is at a position which does not turn relative to the first plate part 5. As a result, the second plate part 3 returns automatically to the non-turning state indicated in FIG. 6 when the turning force is released and can be used repeatedly.

In addition, the height at which the hinge 7 protrudes is such that it has the same thickness as both members so that the thin case 19 on the hinge 7 is at a position equal to the skin-like covering material 22. The skin-like covering material does not readily become wrinkled even if the second member 3 is turned. In addition, the first member 2 is fixed tightly to the first plate part 5 and the second member 3 is fixed tightly to the second member 6 so that the first and second members are linked and can turn at an appropriate strength.

FIGS. 8 through 11 indicate the connecting fastener 25 in a second practical embodiment of the present invention. The point on which connecting fastener 25 differs from connecting fastener 1 is the configuration whereby the first plate is fixed to the first member and the second plate part is fixed to the second member. In the connecting fastener 25, a configuration is set in place whereby it is fixed to the first member and the second member without using a rivet, bolt or other fixing means. Since the other configuration of this connecting fastener 25 is identical to the configuration of connecting fastener 1 and the same numbering is used throughout for the members, we shall not explain these a second time.

In connecting fastener 25, a first fixing part 26 which protrudes to the side of the first member 2 is formed on the first plate part 5. A second fixing part 27 which protrudes to the side of the second member 3 is formed on the second plate part 6. Since the first fixing part 26 and the second fixing part 27 have the same configuration, we shall describe the configuration of the first fixing part 26 as representative for both fixing parts. Fixing part 26 is made up of (1) a shaft part 29 with a small diameter; and (2) a flange 30 with a large diameter which is formed on the end of the shaft part 29. Needless to say, these fixing parts 26 and 27 form an integral piece with the first plate part 5 and the second plate part 6. The length of each shaft part 29 is formed to a length that corresponds to the thickness of the first member 2 and the second member 3.

Figure 10:
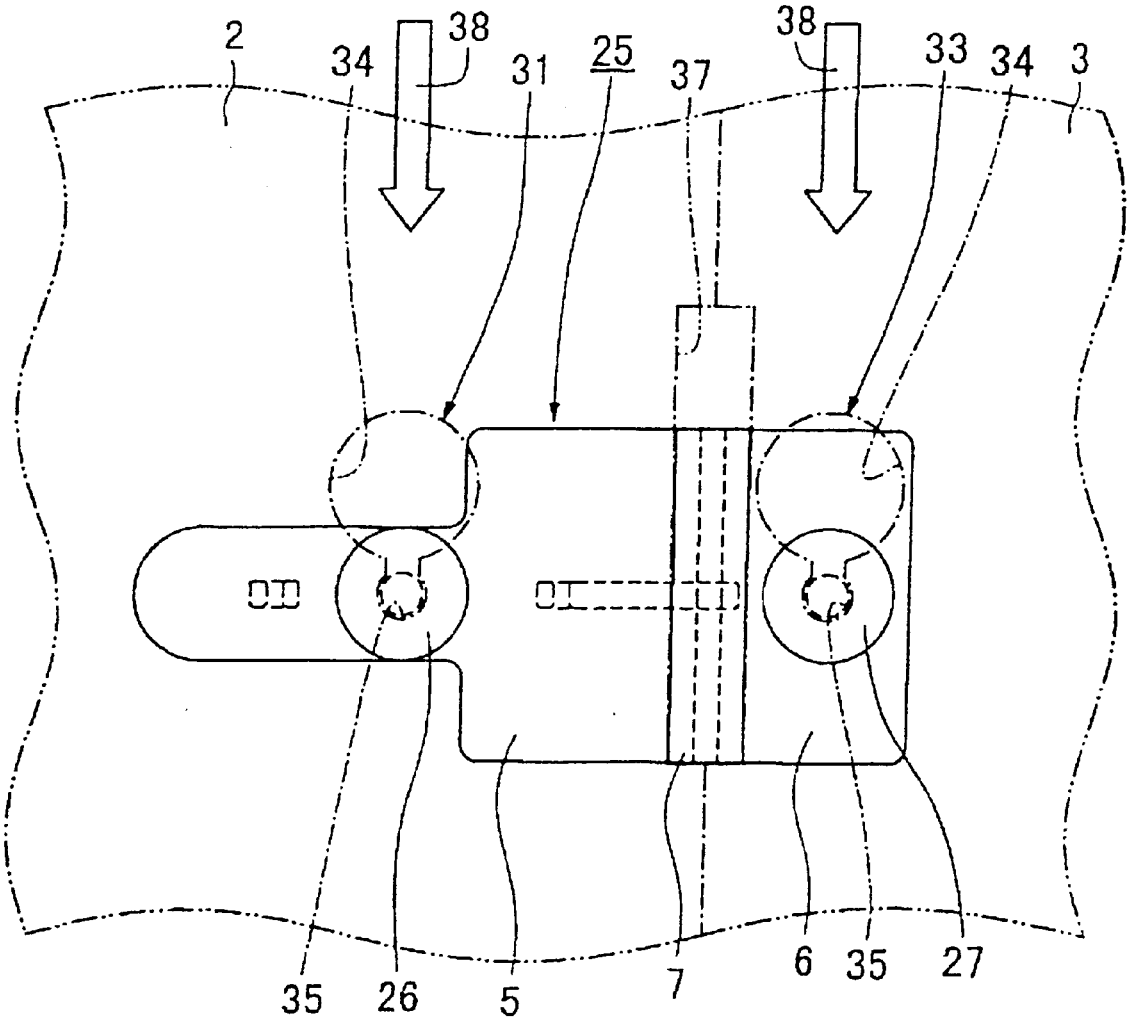
FIG. 10 is a plane view of the connecting fastener in FIG. 8 when attached to a virtually indicated connecting member.

A first attachment hole 31 and a second attachment hole 33 on which the corresponding first fixing part 26 and second fixing part 27 are attached are formed on the first member 2 and the second member 3. These attachment holes 31 and 33 are indicated in FIG. 10. The shape of each of the attachment holes is the same, so that we will describe the shape of the first attachment hole 33 as representative of the others as well. In FIG. 10, the attachment hole 31 is made up of (1) a large hole 34 which accommodates the flange 30; and (2) the adjoining small hole 35 which can accommodate the shaft part 29 but does not go past the flange 30. Such a hole shape may be referred to as a "keyhole". A recessed part 37 which is longer than the recessed part 21 in connecting fastener 1 is formed on the boundary parts at a position where the hinge 7 on the first member 2 and the second member 3 is disposed. This recessed part 37 is shaped so that it is longer than that of the recessed part 21 on connecting fastener 1.

Figure 11:
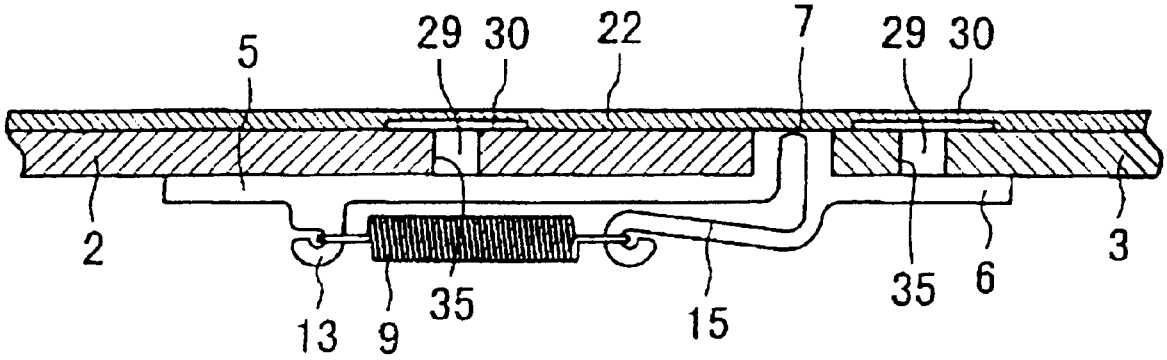
FIG. 11 is a frontal view of the connecting fastener in FIG. 8 when attached to a member.

Next, we shall explain the procedures involved in fixing the connecting fastener 25 to the first member 2 and the second member 3. First, the hinge 7 is inserted in the recessed part 37 on the boundary parts of the first member 1 and the second member 3. At the same time, flange 30 on the first fixing part 26 is inserted in wide diameter hole 34 on the first attachment hole 31 and even flange 30 on the second fixing part 27 is inserted in wide-diameter hole 34 on the second attachment hole 33. This enables the surfaces of first plate part 5 and the second plate part 6 to be brought into contact with the first member 2 and the second member 3. In this state, connecting fastener 25 is slid in the direction indicated by the two arrows 38. By this sliding action, the shaft part 29 on both fixing parts is disposed in the small-diameter hole 35 in the corresponding attachment hole. This makes it possible for the first plate part 5 to be fixed to the first member 2 and for the second plate part 6 to be fixed to the second member, as indicated in FIG. 11. In this fixing action, the means between both plate parts and both members is eliminated so that the height of the shaft part 29 may be made somewhat shorter than the thickness of both members. In addition, a passageway may be formed which is somewhat narrower than the outside diameter of the shaft part 29 on the boundary of the small-diameter hole 35 and the large-diameter hole 34 to prevent the fixation from coming out of place and the shaft part 29 may be made so that it cannot move from small-diameter hole 35 to large-diameter hole 34. If connecting fastener 25 in this second practical embodiment of the present invention is used, not only are rivets, bolts and other types of fixing means unnecessary, but no tools are required for attachment.

In the present invention, a more lightweight piece can be provided by using synthetic resin; the two members can be linked so that they can turn merely by fixing the first plate part to one member and the second plate piece to the other member and returned automatically to a non-turning state even if turned. As a result, the piece can be made lightweight; it can be returned automatically to a non-turning state; the number of parts needed and the number of steps required for attachment can be reduced; and the strength required to link the two members so that they can turn can be obtained. Since the link is retained in a non-turning state, it can be accommodated on an automobile [assembly] line when it is first attached to two members of an automobile trunk board and the like. The synthetic resin members can be maintained in a non-turning state and can be handled easily.

In general, the above-identified embodiments are not to be construed as limiting the breadth of the present invention. It is understood that other modifications or other alternative constructions will be apparent which are within the scope of the invention as defined in the appended claims.

What is claimed is:

1. A connecting fastener to link two members so that one of said members can turn relative to the other, the connecting fastener comprising:

a. a first plate part fixed to one of the said two members;

b. a second plate part fixed to the other of said two members;

c. a hinge part set in place between the first plate part and second plate part and to support both of the plate parts so that they can turn relative to one another, and wherein the first and second plate parts and the hinge part are made of a synthetic resin and are integrally formed;

d. a first spring hooking part is formed on the first plate part;

e. a second spring hooking part is formed on the second plate part and extends under the hinge part to terminate with the first plate part thereabove;

f. a spring having one end connected to the first spring hooking part and the other end connected to the second spring hooking part to resiliently interconnect the first and second plate parts so that both plate parts are energized and will not turn with the hinge part; and g. the spring is latched to each the first spring hooking part and the second spring hooking part in substantially continuous parallel position to the surface of the first plate part and to energize the first and second plate parts in the turning and non-turning positions.

2. The combination claimed in claim 1 wherein:

a. the two members lie in the same plane;

b. the first plate part and the second plate part lie in the same plane and in the non-turning position are disposed parallel to the two members;

c. the first spring hooking part is formed on the first plate part adjacent the end thereof remote from the second plate part; and d. the second spring hooking part is formed on the second plate part and extends over the first plate part a sufficient length whereby the spring is disposed parallel the first plate part in both the turning and the non-turning positions of the second plate part.

3. The combination claimed in claim 2 wherein:

a. a recess is formed to extend into the adjacent ends of the two members; and b. the hinge part is mounted in the recess whereby the parallel relationship of the respective two members, and the first and the second plate parts is maintained in the non-turning position of the second plate part.

* * * * *